US006419795B1

(12) United States Patent
Dutt

(10) Patent No.: US 6,419,795 B1
(45) **Date of Patent: *Jul. 16, 2002**

(54) RESIN-IMPREGNATED BELT HAVING A TEXTURIZED OUTER SURFACE FOR APPLICATION ON PAPERMAKING MACHINES

(75) Inventor: William H. Dutt, Wynantskill, NY (US)

(73) Assignee: Albany International Corp., Albany, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 35 days.

(21) Appl. No.: 09/064,586

(22) Filed: Apr. 22, 1998

(51) Int. Cl.[7] ..... D21F 3/00; B32B 27/04; B32B 27/12

(52) U.S. Cl. ..... 162/358.4; 162/358.3; 162/901; 427/277; 427/278; 428/141; 428/161; 428/409; 442/1; 442/59; 442/181; 442/304; 442/327; 442/86

(58) Field of Search ..... 162/901, 358.4, 162/358.3; 198/804, 846; 427/277, 278; 428/141, 161, 164, 409; 442/1, 59, 181.86, 327, 304

(56) References Cited

U.S. PATENT DOCUMENTS

| | | | | | |
|---|---|---|---|---|---|
| 4,559,258 | A | | 12/1985 | Kiuchi | 428/156 |
| 4,643,916 | A | * | 2/1987 | Kiuchi | 427/176 |
| 4,946,731 | A | | 8/1990 | Dutt | 428/156 |
| 5,196,092 | A | * | 3/1993 | Stigberg | 162/358.4 |
| 5,208,087 | A | * | 5/1993 | Stigberg | 428/60 |
| 5,238,537 | A | * | 8/1993 | Dutt | 162/358.4 |
| 5,753,085 | A | * | 5/1998 | FitzPatrick | 162/358.4 |
| 5,772,848 | A | * | 6/1998 | Dutt | 162/358.4 |
| 5,792,323 | A | * | 8/1998 | Grondahl | 162/358.4 |
| 5,837,080 | A | * | 11/1998 | Grondahl | 156/73.4 |

FOREIGN PATENT DOCUMENTS

| | | |
|---|---|---|
| DE | 3827486 A1 | 8/1988 |
| EP | 0 659 934 A2 | 12/1994 |
| EP | 0 761 873 A1 | 9/1996 |
| EP | 0 939 162 A2 | 2/1999 |

OTHER PUBLICATIONS

English translation of Abstract of German Patent Document DE 38 27 486A1, filing date Aug. 12, 1988.

* cited by examiner

*Primary Examiner*—Terrel Morris
*Assistant Examiner*—Ula C. Ruddock
(74) *Attorney, Agent, or Firm*—Frommer, Lawrence & Haug LLP; Ronald R. Santucci

(57) ABSTRACT

A method for manufacturing a resin-impregnated endless belt structure having a texturized outer surface requires the use of a support structure, either a cylindrical mandrel or a pair of carrying rolls, having a texturized surface. An endless, permeable base structure is placed about the support structure, which is adapted to place the base structure under tension in a longitudinal direction. A polymeric resin material is dispensed onto the outside of the base structure on the support structure. The polymeric resin material totally impregnates the base structure and passes therethrough to coat the texturized surface of the support structure. A layer of polymeric resin material is also built up on the outside of the base structure. The polymeric resin material is then cured, and may be ground to provide the layer of polymeric resin material with a smooth, uniform surface, and the belt structure thus obtained is removed from the support structure. The belt structure is finally turned inside out, placing an impression of the texturized surface of the support structure on the outside of the belt structure, that texturized surface having a plurality of indentations for the temporary storage of water pressed from a fibrous web in a press nip.

24 Claims, 6 Drawing Sheets

RESIN-IMPREGNATED BELT HAVING A TEXTURIZED OUTER SURFACE FOR APPLICATION ON PAPERMAKING MACHINES

BACKGROUND OF THE INVENTION

1. Field of the Invention

The present invention relates to mechanisms for extracting water from a web of material, and, more particularly, from a fibrous web being processed into a paper product on a papermaking machine. Specifically, the present invention is a method for manufacturing resin-impregnated endless belt structures, having texturized outer surfaces and designed for use on a long nip press of the shoe type on a papermaking machine, and the belt structures manufactured in accordance with the method.

2. Description of the Prior Art

During the papermaking process, a fibrous web of cellulosic fibers is formed on a forming wire by depositing a fibrous slurry thereon in the forming section of a paper machine. A large amount of water is drained from the slurry in the forming section, after which the newly formed web is conducted to a press section. The press section includes a series of press nips, in which the fibrous web is subjected to compressive forces applied to remove water therefrom. The web finally is conducted to a drying section which includes heated dryer drums around which the web is directed. The heated dryer drums reduce the water content of the web to a desirable level through evaporation to yield a paper product.

Rising energy costs have made it increasingly desirable to remove as much water as possible from the web prior to its entering the dryer section. As the dryer drums are often heated from within by steam, costs associated with steam production can be substantial, especially when a large amount of water needs to be removed from the web.

Traditionally, press sections have included a series of nips formed by pairs of adjacent cylindrical press rolls. In recent years, the use of long press nips of the shoe type has been found to be more advantageous than the use of nips formed by pairs of adjacent press rolls. This is because the longer the time a web can be subjected to pressure in the nip, the more water can be removed there, and, consequently, the less water will remain behind in the web for removal through evaporation in the dryer section.

The present invention relates to long nip presses of the shoe type. In this variety of long nip press, the nip is formed between a cylindrical press roll and an arcuate pressure shoe. The latter has a cylindrically concave surface having a radius of curvature close to that of the cylindrical press roll. When the roll and shoe are brought into close physical proximity to one another, a nip which can be five to ten times longer in the machine direction, that is, in the direction in which the web travels through the paper machine, than one formed between two press rolls is formed. Since the long nip is five to ten times longer than that in a conventional two-roll press, the so-called dwell time of the fibrous web in the long nip is correspondingly longer under the same level of pressure per square inch in pressing force used in a two-roll press. The result of this new long nip technology has been a dramatic increase in dewatering of the fibrous web in the long nip when compared to conventional nips on paper machines.

A long nip press of the shoe type requires a special belt, such as that shown in U.S. Pat. No. 5,238,537. This belt is designed to protect the press fabric supporting, carrying and dewatering the fibrous web from the accelerated wear that would result from direct, sliding contact over the stationary pressure shoe. Such a belt must be provided with a smooth, impervious inner surface that rides, or slides, over the stationary shoe on a lubricating film of oil. The belt moves through the nip at roughly the same speed as the press fabric, thereby subjecting the press fabric to minimal amounts of rubbing against the surface of the belt.

Belts of the variety shown in U.S. Pat. No. 5,238,537 are made by impregnating a woven base fabric, which takes the form of an endless loop, with a synthetic polymeric resin. Preferably, the resin forms a coating of some predetermined thickness on at least the inner surface of the belt, so that the yarns from which the base fabric is woven may be protected from direct contact with the arcuate pressure shoe component of the long nip press. It is specifically this coating which must have a smooth, impervious surface to slide readily over the lubricated shoe and to prevent any of the lubricating oil from penetrating the structure of the belt to contaminate the press fabric, or fabrics, and fibrous web.

The base fabric of the belt shown in U.S. Pat. No. 5,238,537 may be woven from monofilament yarns in a single- or multi-layer weave, and is woven so as to be sufficiently open to allow the impregnating material to totally impregnate the weave. This eliminates the possibility of any voids forming in the final belt. Such voids may allow the lubrication used between the belt and shoe to pass through the belt and contaminate the press fabric or fabrics and fibrous web. The base fabric may be flat-woven, and subsequently seamed into endless form, or woven endless in tubular form.

When the impregnating material is cured to a solid condition, it is primarily bound to the base fabric by a mechanical interlock, wherein the cured impregnating material surrounds the yarns of the base fabric. In addition, there may be some chemical bonding or adhesion between the cured impregnating material and the material of the yarns of the base fabric.

Long nip press belts, such as that shown in U.S. Pat. No. 5,238,537, depending on the size requirements of the long nip presses on which they are installed, have lengths from roughly 13 to 35 feet (approximately 4 to 11 meters), measured longitudinally around their endless-loop forms, and widths from roughly 100 to 450 inches (approximately 250 to 1125 centimeters), measured transversely across those forms. It will be appreciated that the manufacture of such belts is complicated by the requirement that the base fabric be endless prior to its impregnation with a synthetic polymeric resin.

It is often desirable to provide the belt with a resin coating of some predetermined thickness on its outer surface as well as on its inner surface. By coating both sides of the belt, its woven base fabric will be closer to, if not coincident with, the neutral axis of bending of the belt. In such a circumstance, the internal stresses which arise when the belt is flexed on passing around a roll or the like on a paper machine will be less likely to cause the coating to delaminate from either side of the belt.

Moreover, when the outer surface of the belt has a resin coating of some predetermined thickness, it permits grooves, blind holes or other cavities to be formed on that surface without exposing any part of the woven base fabric. These features provide for the temporary storage of water pressed from the web in the press nip.

It will be appreciated that such grooves or blind holes are usually produced by graving or drilling in a separate manufacturing step following the curing of the resin coating.

The present invention provides a solution to this particular problem, that is, the necessity for a separate manufacturing step, which characterizes prior-art methods for manufacturing resin-impregnated endless belt structures having void volume in the form of grooves, blind holes and the like on their outer surfaces.

SUMMARY OF THE INVENTION

Accordingly, the object of the present invention is to provide a method for manufacturing a resin-impregnated endless belt structure having a texturized outer surface, which provides the outer surface of the belt structure with void volume for the temporary storage of water pressed from a fibrous web in a press nip. The texturized outer surface represents an improvement over the grooves, blind holes and the like of the prior art.

The present invention, therefore, is the method for manufacturing the resin-impregnated endless belt structure, and the resulting product, for use in the papermaking process where an endless belt, impermeable to water, oil and other fluids, and having a texturized outer surface with a plurality of indentations for the temporary storage of water pressed from a paper web, is desirable.

In a first embodiment of the method, an endless, permeable base structure having a length measured therearound in a longitudinal direction, and having an inside and an outside, is placed about a support structure. The support structure has a texturized surface, and is adapted to place the base structure under tension in a longitudinal direction. The "texturized" surface has a plurality of protruding elements which are separate and distinct from one another. The support structure may be either a cylindrical mandrel or a pair of carrying rolls.

While on the support structure, the base structure is totally impregnated with a polymeric resin material. The polymeric resin material is dispensed onto the outside of the base structure, and passes completely therethrough to contact the texturized surface of the support structure and to provide an impression of the texturized surface on the polymeric resin material on the inside of the base structure. The polymeric resin material also forms a layer on the outside of the base structure. The polymeric resin material is then cured and ground to provide it with a smooth, uniform surface, and the belt structure thus obtained is removed from the support structure. The belt structure is finally turned inside out to place the impression of the texturized surface of the support structure on the outside of the belt structure.

In a second embodiment of the method, an endless, permeable base structure having a length measured therearound in a longitudinal direction, and having an inside and an outside, is again placed about a support structure. In this embodiment, the support structure has a smooth, polished surface, and is again adapted to place the base structure under tension in a longitudinal direction. The support structure may again be either a cylindrical mandrel or a pair of carrying rolls.

While on the support structure, the base structure is again totally impregnated with a polymeric resin material. The polymeric resin material is dispensed onto the outside of the base structure, passes completely therethrough to contact the smooth, polished surface of the support structure, and forms a layer on the outside of the base structure. The polymeric resin material is then cured and ground to provide it with a smooth, uniform surface.

The base structure, now coated on one side, is then removed from the support structure; inverted (turned inside out) to place the coating on its inner surface; and reinstalled about the support structure. The polymeric resin material is again dispensed onto the outside of the base structure, forming a layer thereon. A medium having a texturized surface, such as a woven fabric belt, is then used to impress a corresponding texturized surface into the layer of the polymeric resin material on the outside of the base structure.

The polymeric resin material is then cured, and the belt structure thus obtained is removed from the support structure.

It follows that, when manufactured according to either method, the product belt comprises a base structure in the form of an endless loop having an outer side and an inner side. A polymeric resin material impregnates the base structure and renders the base structure impermeable to fluids, such as oil and water. The polymeric resin material also forms an inner layer on the inner side of the base structure. The inner layer has a smooth surface. On the outer side of the base structure, the polymeric resin material forms an outer layer which has a texturized surface impressed thereon either by a support structure having a texturized surface or by a belt having such a surface.

The several embodiments of the present invention will now be described in more complete detail. In the description to follow, frequent reference will be made to the drawing figures identified immediately below.

DETAILED DESCRIPTION OF THE PREFERRED EMBODIMENTS

Figure 1:
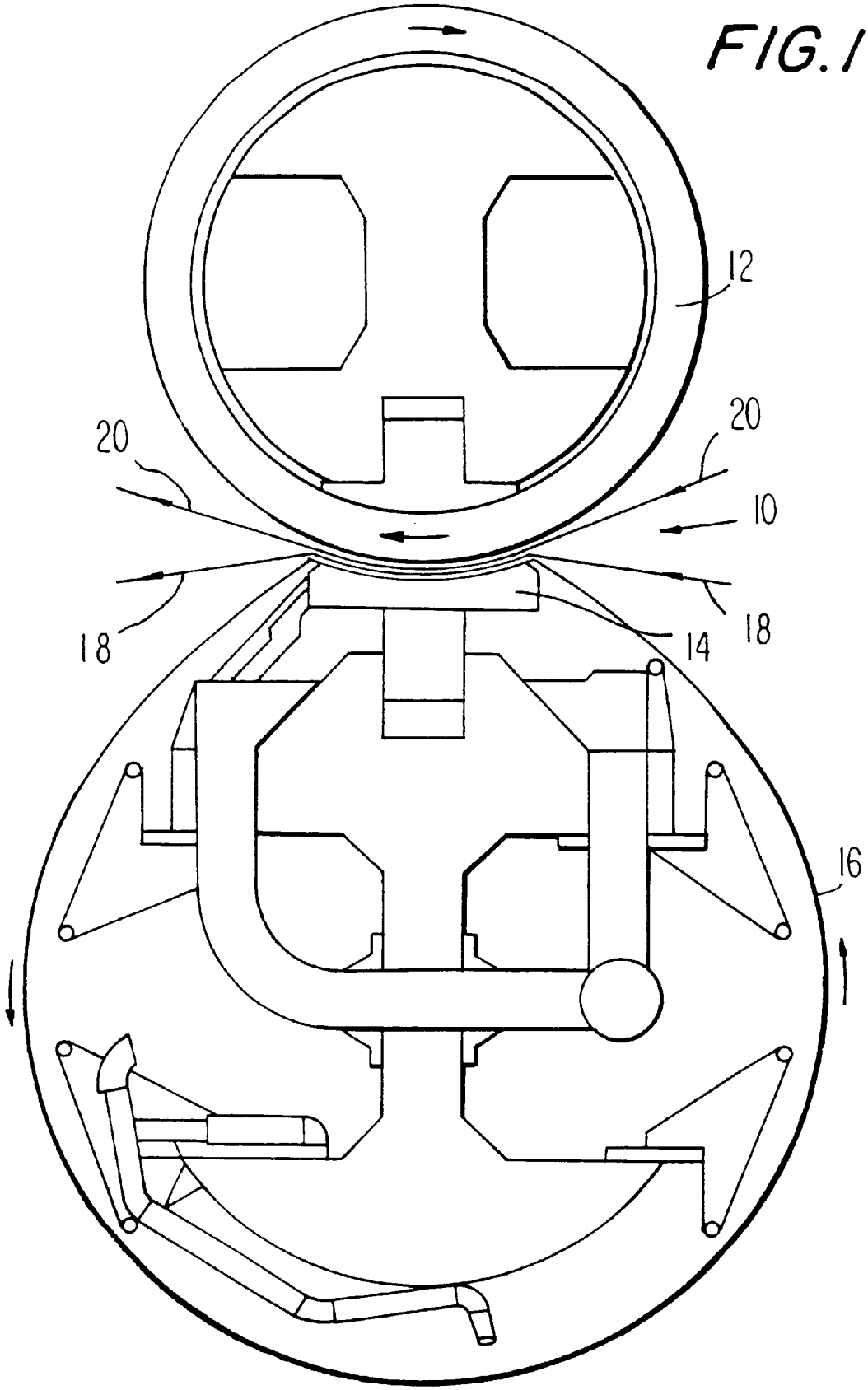
FIG. 1 is a side cross-sectional view of a long nip press.

A long nip press for dewatering a fibrous web being processed into a paper product on a paper machine is shown in a side cross-sectional view in FIG. 1. The press nip 10 is defined by a smooth cylindrical press roll 12 and an arcuate pressure shoe 14. The arcuate pressure shoe 14 has about the same radius of curvature as the cylindrical press roll 12. The distance between the cylindrical press roll 12 and the arcuate pressure shoe 14 may be adjusted by hydraulic means operatively attached to arcuate pressure shoe 14 to control the loading of the nip 10. Smooth cylindrical press roll 12 may be a controlled crown roll matched to the arcuate pressure shoe 14 to obtain a level cross-machine nip profile.

Endless belt structure 16 extends in a closed loop through nip 10, separating press roll 12 from arcuate pressure shoe 14. A wet press fabric 18 and a fibrous web 20 being processed into a paper sheet pass together through nip 10 as indicated by the arrows in FIG. 1. Fibrous web 20 is supported by wet press fabric 18 and comes into direct contact with smooth cylindrical press roll 12 in nip 10. Fibrous web 20 and wet press fabric 18 proceed through the nip 10 as indicated by the arrows. Endless belt structure 16, also moving through press nip 10 as indicated by the arrows, that is, counter-clockwise as depicted in FIG. 1, protects wet press fabric 18 from direct sliding contact against arcuate pressure shoe 14, and slides thereover on a lubricating film of oil. Endless belt structure 16, accordingly, must be impermeable to oil, so that wet press fabric 18 and fibrous web 20 will not be contaminated thereby.

Figure 2:
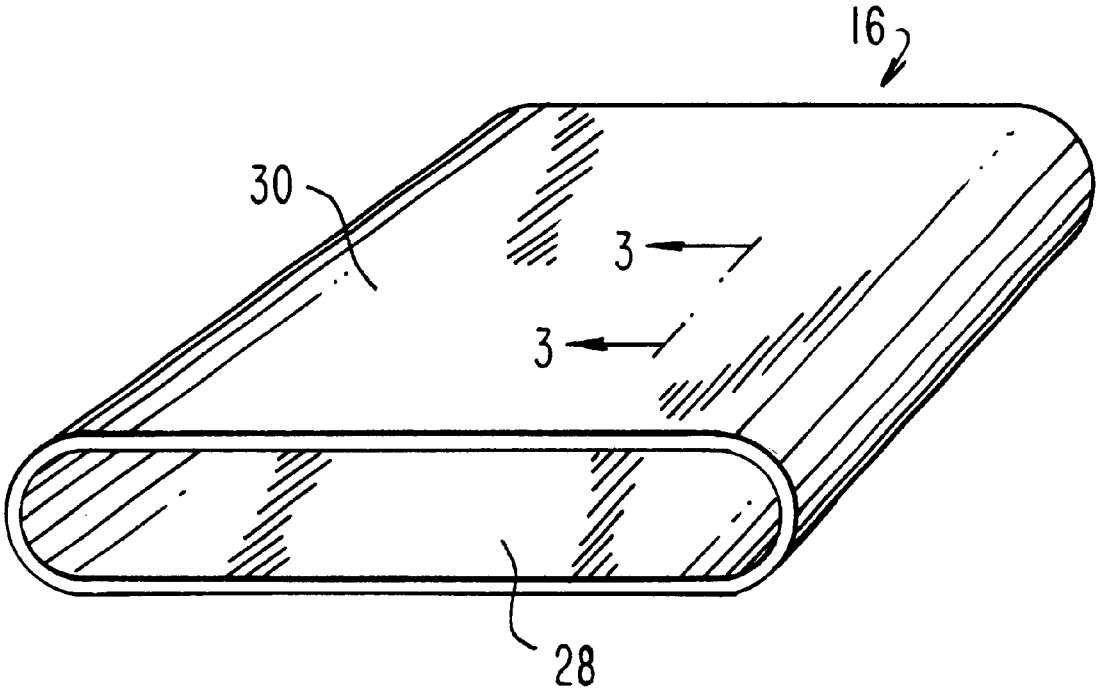
FIG. 2 is a perspective view of a belt made in accordance with the method of the present invention.

A perspective view of belt 16 is provided in FIG. 2. The belt 16 has an inner surface 28 and an outer surface 30. The inner surface 28 is smooth, while outer surface 30 is texturized and has a plurality of surface indentations for the temporary storage of water pressed from fibrous web 20 in press nip 10.

Figure 3:
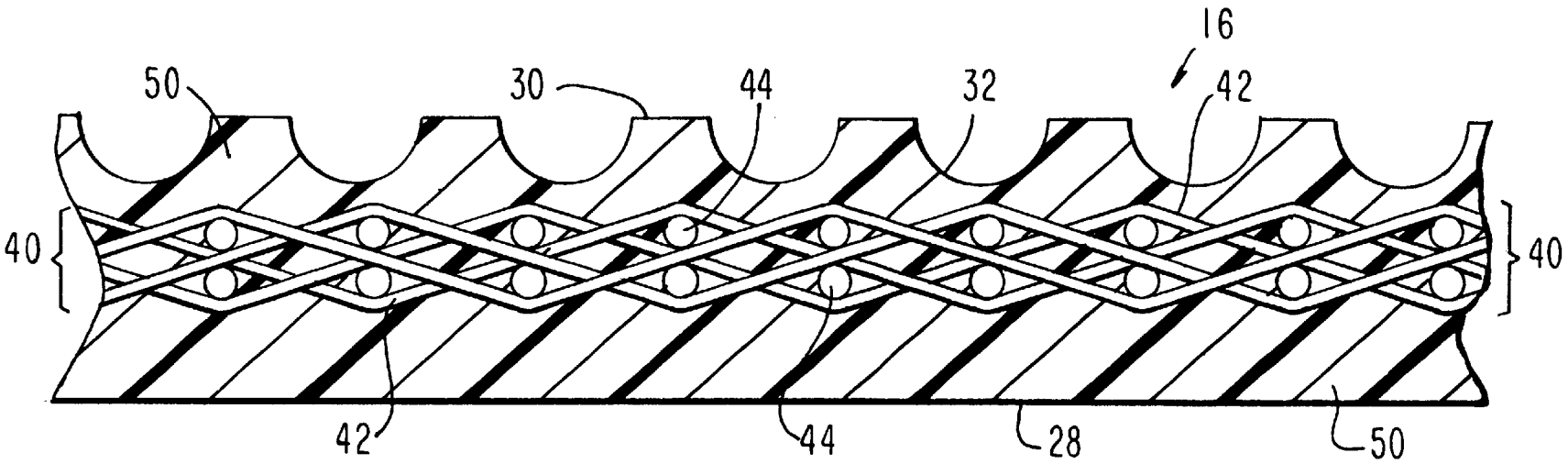
FIG. 3 is a cross-sectional view of the belt taken as indicated by line 3—3 in FIG. 2.

FIG. 3 is a cross-sectional view of the belt taken as indicated by line 3—3 in FIG. 2. The cross section is taken in the transverse, or cross-machine, direction of the belt 16. The outer surface 30 has a plurality of surface indentations 32, thereby making that outer surface 30 texturized.

The belt 16 includes a base structure 40. The base structure 40 is woven from transverse, or cross-machine-direction, yarns 42, seen from the side in FIG. 3, and longitudinal, or machine-direction, yarns 44, seen in cross section in FIG. 3. Base structure 40 is depicted as having been woven endless, and transverse yarns 42 depicted as warp yarns weaving over, under and between the stacked pairs of longitudinal yarns 44, the weft yarns in the endless weaving process, in a duplex weave. It should be understood, however, that base structure 40 may be flat-woven, and subsequently joined into endless form with a seam. It should be further understood that base structure 40 may be woven in a single-layer weave, or in any other weave which may be used in the production of papermachine clothing.

The base structure 40 may alternatively be a non-woven fabric in the form of an assembly of transverse and longitudinal yarns bonded together at their mutual crossing points. Further, the base structure 40 may be a knitted or braided fabric, or a spiral-link belt of the type shown in U.S. Pat. No. 4,567,077 to Gauthier, the teachings of which are incorporated herein by reference. The base structure 40 may also be extruded from a polymeric resin material in the form of a sheet or membrane, which may subsequently be provided with holes or perforations. Alternatively still, the base structure 40 may comprise mesh fabrics, such as those shown in commonly assigned U.S. Pat. No. 4,427,734 to Johnson, the teachings of which are incorporated herein by reference.

Further, the base structure 40 may be produced by spirally winding a strip of woven, nonwoven, knitted, braided, extruded or mesh material according to the methods shown in commonly assigned U.S. Pat. No. 5,360,656 to Rexfelt et al., the teachings of which are incorporated herein by reference. The base structure 40 may accordingly comprise a spirally wound strip, wherein each spiral turn is joined to the next by a continuous seam making the base structure 40 endless in a longitudinal direction.

The inner surface 28 and the outer surface 30 of the belt 16 are formed by a polymeric resin material 50, which impregnates the base structure 40 and renders the belt 16 impervious to oil and water. The polymeric resin material 50 is preferably of the reactive type, either chemically cross-linked with a catalyst or cross-linked with the application of heat. Polymeric resin materials 50 having a 100% solids composition, that is, lacking a solvent, are preferred, as solvents tend to generate bubbles during the curing process. Polyurethane resins having 100% solids compositions are preferred.

Figure 4:
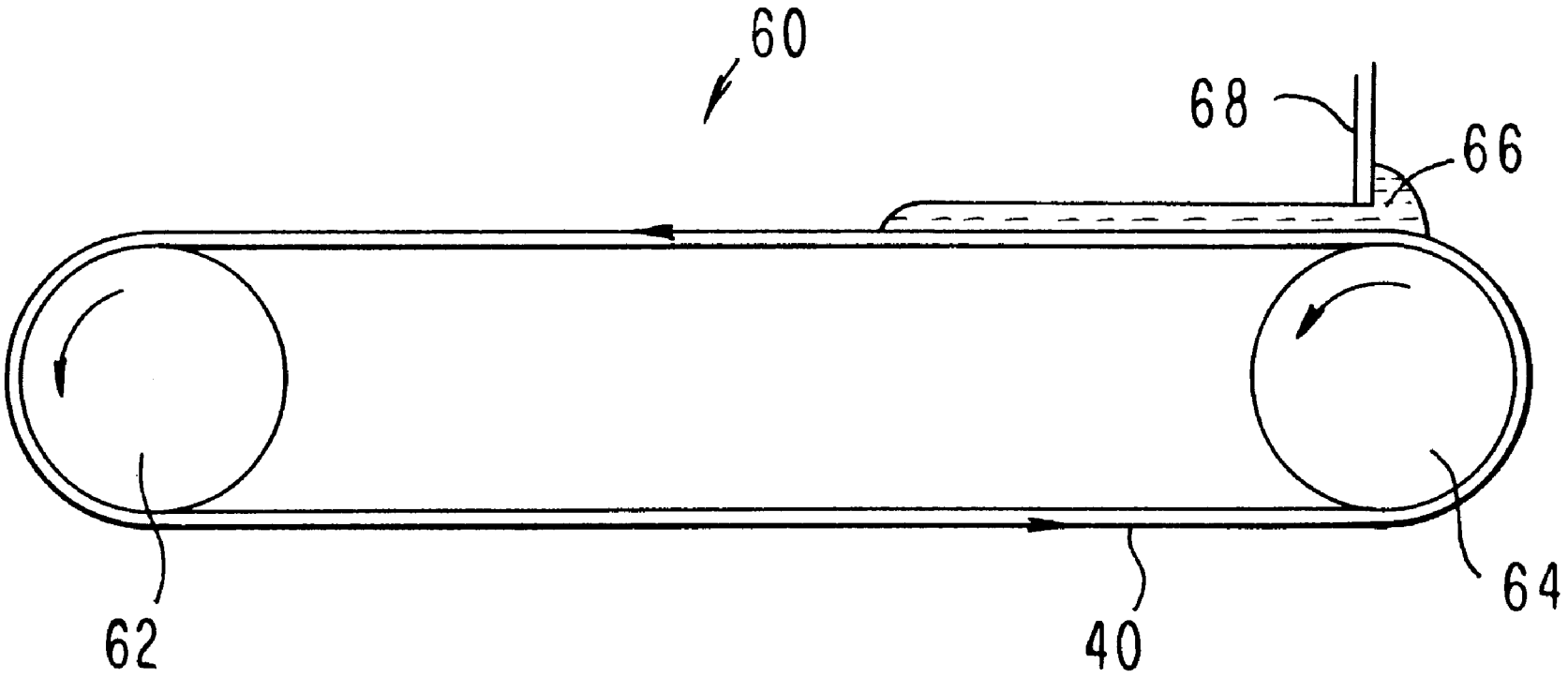
FIG. 4 is a schematic view of an apparatus used to manufacture the belt of the present invention.

FIG. 4 is a schematic view of an apparatus 60 used to manufacture the belt of the present invention. Apparatus 60 comprises a first carrying roll 62 and a second carrying roll 64, which may be moved relative to one another to place base structure 40 under tension in a longitudinal direction. Together, first carrying roll 62 and second carrying roll 64 comprise a support structure about which the base structure 40 is disposed during the process in which it is impregnated and coated with a polymeric resin material. As an alternative to carrying rolls 62,64, a cylindrical mandrel having a circumference substantially equal to the length of the base structure 40 may be used as the support structure.

One of the carrying rolls 62,64, or the cylindrical mandrel, has a texturized surface comprising a plurality of surface irregularities or departures from absolute smoothness.

Once the base structure 40 is disposed about the first and second carrying rolls 62,64, and placed under tension in a longitudinal direction, it is coated with a polymeric resin material 66. This may be accomplished by moving the base structure 40 as suggested by the arrows in FIG. 4, and by dispensing the polymeric resin material 66 upstream from a coating bar 68, so that a uniformly thick layer of the polymeric resin material 66 will be applied to the outside of the base structure 40.

The polymeric resin material 66 totally impregnates the base structure 40, and passes therethrough to the inside of the base structure 40, where it contacts the texturized surface of the one of the two carrying rolls 62,64 having a texturized surface. This contact makes an impression of the texturized surface on the polymeric resin material 66 on the inside of the base structure 40.

The polymeric resin material 66 is then cured while the base structure 40 remains on the support structure. To facilitate the eventual removal of the belt 16 from the support structure, the support structure may be coated with a material, such as polyethylene, polytetrafluoroethylene (PTFE) or silicone, which will readily release a polymeric resin material cured thereon.

Before removing the belt 16 so formed from the support structure, the outer surface may be ground and buffed to provide the layer of polymeric resin material disposed there with a smooth, uniform surface. The belt 16, once removed from the support structure, is then turned inside out, placing the smooth surface on the inside and the texturized surface on the outside, for use on a paper machine.

The cylindrical mandrel, or at least one of the carrying rolls 62,64, may be provided with a texturized surface by means of a sleeve-like covering in the form of a woven fabric, the knuckles of which will impress a texturized surface onto the coating of polymeric resin material 66 of a belt 16 being manufactured thereon. One such fabric is described below.

Figure 5:
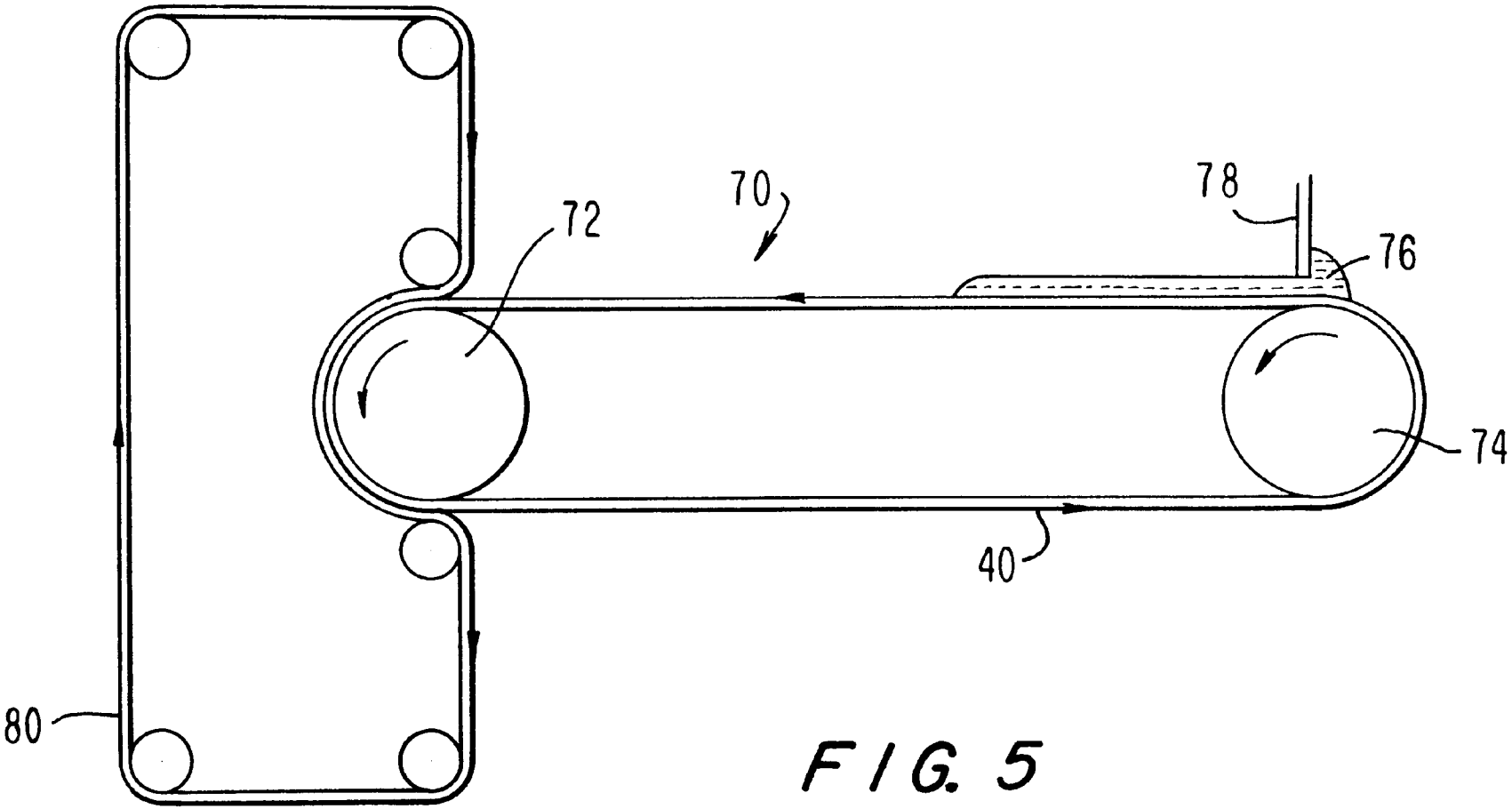
FIG. 5 is a schematic view of an alternate apparatus used for the same purpose.

FIG. 5 is a schematic view of an alternate apparatus for manufacturing the belt of the present invention. Apparatus 70 comprises a first carrying roll 72 and a second carrying roll 74, which may be moved relative to one another to place base structure 40 under tension in a longitudinal direction. Again, the first carrying roll 72 and the second carrying roll 74 comprise a support structure for the base structure 40 during the coating process. Alternatively, a cylindrical mandrel having a circumference substantially equal to the length of the base structure 40 may be used as the support structure.

Both carrying rolls 72,74, or the cylindrical mandrel, have smooth, polished surfaces. As above, these may be coated with a material which will readily release a polymeric resin material cured thereon.

Once the base structure 40 is disposed about the first and second carrying rolls 72,74, and placed under tension in a longitudinal direction, it is coated with a polymeric resin material 76. As above, this may be accomplished by moving the base structure 40 as suggested by the arrows in FIG. 5, and by dispensing the polymeric resin material 76 upstream from a coating bar 78, so that a uniformly thick layer of the polymeric resin material 76 will be applied to the outside of the base structure 40.

The polymeric resin material 76 totally impregnates the base structure 40, and passes therethrough to the inside of the base structure 40, where it contacts the smooth surface of the carrying rolls 72,74 (or cylindrical mandrel). The polymeric resin material 76 also forms a layer on the outside of the base structure 40.

The polymeric resin material 76 is then cured while the base structure 40 remains on the support structure. After curing, the polymeric resin material 76 may be ground and buffed to provide it with a smooth, uniform surface. Thereafter, the base structure 40 with its coating of polymeric resin material 76 is removed from the support structure, inverted (turned inside out), and placed back onto the support structure with its smooth coated surface on the inside.

Again, the base structure 40, now having a coating on its inner surface, is placed under tension in a longitudinal direction by the first and second carrying rolls 72,74, and coated with polymeric resin material 76. As above, this may be accomplished by moving the base structure 40 having a coating on its inner surface in the manner suggested by the arrows in FIG. 5, and by dispensing the polymeric resin material 76 upstream from a coating bar 78, so that a uniformly thick layer of polymeric resin material 76 will be applied to the outside of the base structure 40. The polymeric resin material 76 forms a layer on the outside of the base structure 40.

A medium having a texturized surface, such as a texturizing belt 80, is then arranged to wrap around one of the two carrying rolls 72,74 (or cylindrical mandrel) for a portion of its circumference to impress the pattern of its texturized surface into the layer of polymeric resin material 76 on the outside of the base structure 40. The texturizing belt 80 may be a woven fabric, the knuckles of which will impress a texturized surface onto the coating of polymeric resin material 76 on the base structure 40.

The polymeric resin material 76 is then cured while the base structure 40 remains on the support structure, and, finally, the belt 16 obtained is removed from the support structure for use on a paper machine.

Figure 6:
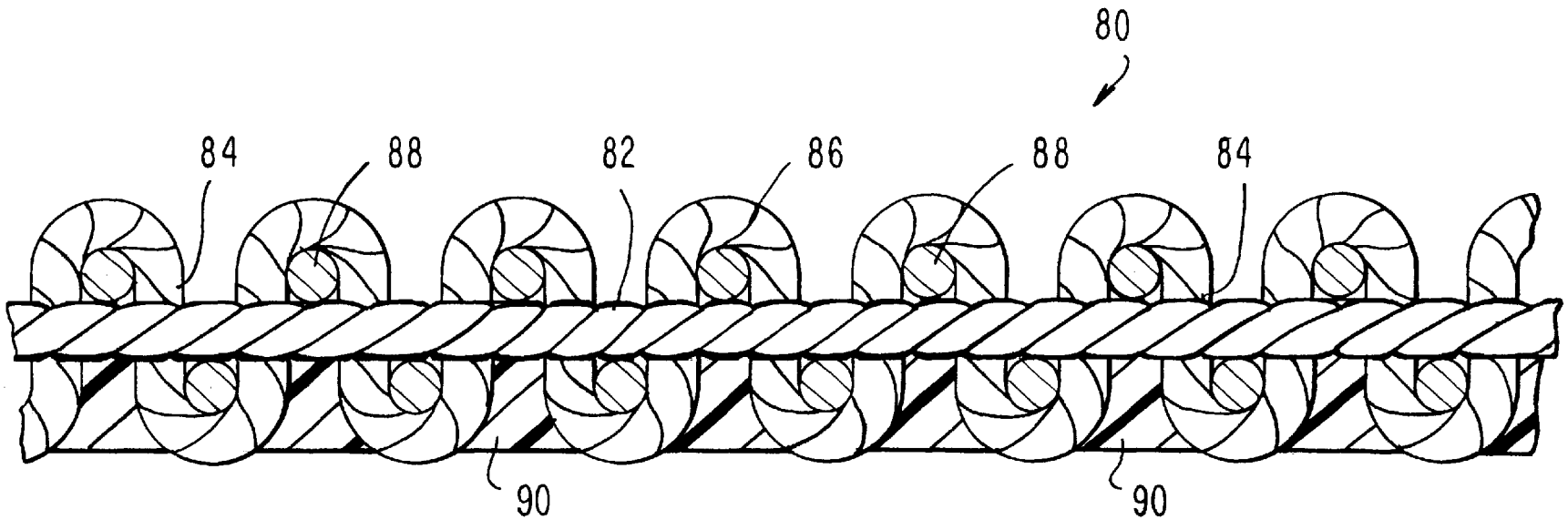
FIG. 6 is a cross-sectional view of a texturizing belt which may be used in the practice of the present invention.

FIG. 6 is a cross-sectional view of a texturizing belt 80 which may be used in the practice of the present invention. The texturizing belt 80 may be woven from heavy gauge cotton cordage in both the warp and filling directions. The weave shown is a simple plain weave utilizing two warp systems drawn in an alternating arrangement. That is to say, one warp yarn 82 is drawn in from one loom beam, and the other warp yarn 84 is drawn in from a second loom beam. When weaving, one beam is set at an extremely high tension so that it does little or no bending during the weaving process. The second warp beam is set with very little warp tension so that it does a great deal of bending. This produces a structure where one system of warp yarns 82 lies straight in the middle of the texturizing belt 80, and the second system of warp yarns 84 produces protrusions 86 on both sides of the texturizing belt 80. These may be used to impart a desired texture to a coated belt. The filling-direction yarns 88 are either above or below the first warp yarns 82. Although either side of the woven structure may be used to impart a texture to a coated fabric surface, texturizing belt 80 may be impregnated through a portion of its thickness with a polymeric resin material 90 to provide the texturizing belt 80 with added stability.

Modifications to the above would be obvious to those of ordinary skill in the art, but would not bring the invention so modified beyond the scope of the appended claims.

What is claimed is:

1. A method for manufacturing a resin-impregnated endless belt structure having an outer surface with a plurality of indentations, said indentations being knuckle-shaped impressions spaced apart from one another, said method comprising the steps of:

a) providing an endless, permeable base structure for said endless belt structure, said base structure having a length measured therearound in a longitudinal direction, and having an inside and an outside;

b) providing a support structure having a surface with a plurality of knuckle-shaped protruding elements, said protruding elements being spaced apart from one another, said support structure being adapted to place said base structure under tension in a longitudinal direction;

c) placing said base structure about said support structure, said support structure providing said tension to said base structure in a longitudinal direction, said inside of said base structure thereby being in contact with said surface of said support structure;

d) dispensing a polymeric resin material onto said outside of said base structure on said support structure, said polymeric resin material totally impregnating said base structure and passing therethrough, thereby contacting said surface of said support structure to provide an impression of said surface on said polymeric resin material, said polymeric resin material forming a layer on said outside of said base structure;

e) curing said polymeric resin material;

f) removing said belt structure thus obtained from said support structure; and g) turning said belt structure inside out, thereby placing said impression of said surface of said support structure on the outside of said belt structure.

2. The method as claimed in claim 1 further comprising, between steps e) and f), the step of grinding said layer of polymeric resin material to provide it with a smooth, uniform surface.

3. The method as claimed in claim 1 wherein said support structure is a cylindrical mandrel, said cylindrical mandrel having a circumference substantially equal to said length of said base structure, so that said base structure will be under tension in a longitudinal direction when placed thereon.

4. The method as claimed in claim 3 wherein said cylindrical mandrel is covered with a sleeve, said sleeve being a woven fabric, said fabric being woven from yarns producing a plurality of knuckles forming protrusions on a side thereof, thereby providing said cylindrical mandrel with a surface having said plurality of protruding knuckle-shaped elements.

5. The method as claimed in claim 1 wherein said support structure is a pair of carrying rolls, one of said carrying rolls having said surface with said plurality of protruding knuckle-shaped elements, said carrying rolls being parallel to one another and separable from one another so as to enable said base structure placed thereabout to be placed under tension in a longitudinal direction.

6. The method as claimed in claim 5 wherein said one of said pair of carrying rolls is covered with a sleeve, said sleeve being a woven fabric, said fabric being woven from yarns producing a plurality of knuckles forming protrusions on a side thereof, thereby providing said carrying roll with a surface having said plurality of protruding knuckle-shaped elements.

7. A method for manufacturing a resin-impregnated endless belt structure having an outer surface with a plurality of indentations, said indentations being knuckle-shaped impressions spaced apart from one another, said method comprising the steps of:

a) providing an endless, permeable base structure for said endless belt structure, said base structure having a length measured therearound in a longitudinal direction, and having an inside and an outside;

b) providing a support structure having a smooth, polished surface, said support structure being adapted to place said base structure under tension in a longitudinal direction;

c) placing said base structure about said support structure, said support structure providing said tension to said base structure in a longitudinal direction, said inside of said base structure thereby being in contact with said smooth, polished surface of said support structure;

d) dispensing a polymeric resin material onto said outside of said base structure on said support structure, said polymeric resin material totally impregnating said base structure and passing therethrough, said polymeric resin material forming a layer on said outside of said base structure;

e) curing said polymeric resin material;

f) removing said base structure from said support structure;

g) turning said base structure inside out to place said layer of polymeric resin material on the inside thereof;

h) replacing said base structure about said support structure, said support structure again providing said tension to said base structure in a longitudinal direction, said layer of said polymeric resin material on said inside of said base structure thereby being in contact with said smooth polished surface of said support structure;

i) providing a medium having a surface with a plurality of protruding knuckle-shaped elements for impressing a corresponding surface onto an uncured polymeric resin material, said protruding elements being spaced apart from one another;

j) dispensing a polymeric resin material onto said outside of said base structure, said polymeric resin material forming a layer on said outside of said base structure;

k) impressing said medium having said surface with said plurality of protruding knuckle-shaped elements into said layer of said polymeric resin material on said outside of said base structure to provide said layer with a corresponding surface having said plurality of indentations, said indentations being said knuckle-shaped impressions spaced apart from one another;

l) curing said polymeric resin material; and m) removing said belt structure thus obtained from said support structure.

8. The method as claimed in claim 7 further comprising, between steps e) and f), the step of grinding said layer of polymeric resin material to provide it with a smooth, uniform surface.

9. The method as claimed in claim 7 wherein said support structure having a smooth, polished surface is a cylindrical mandrel, said cylindrical mandrel having a circumference substantially equal to said length of said base structure, so that said base structure will be under tension in a longitudinal direction when placed thereon.

10. The method as claimed in claim 9 wherein said medium having said surface with said plurality of protruding knuckle-shaped elements is a belt in the form of a woven fabric, said fabric being woven from yarns producing a plurality of knuckles forming protrusions on a side thereof, said belt wrapping around a portion of the circumference of said cylindrical mandrel to provide said layer of polymeric resin material with a corresponding surface having said plurality of indentations.

11. The method as claimed in claim 7 wherein said support structure having a smooth, polished surface is a pair of carrying rolls having smooth, polished surfaces, said carrying rolls being parallel to one another and separable from one another so as to enable said base structure placed thereabout to be placed under tension in a longitudinal direction.

12. The method as claimed in claim 11 wherein said medium having said surface with said plurality of protruding knuckle-shaped elements is a belt in the form of a woven fabric, said fabric being woven from yarns producing a plurality of knuckles forming protrusions on a side thereof, said belt wrapping around a portion of the circumference of one of said pair of carrying rolls to provide said layer of polymeric resin material with a corresponding surface having said plurality of indentations.

13. The method as claimed in claim 7 wherein said medium having said surface with said plurality of protruding knuckle-shaped elements is a belt in the form of a woven fabric, said fabric being woven from yarns producing a plurality of knuckles forming protrusions on a side thereof.

14. A resin-impregnated belt for a long nip press of the shoe type, said resin-impregnated endless belt comprising:

a base structure, said base structure being in the form of an endless loop and having an outer side and an inner side; and a polymeric resin material impregnating said base structure and rendering said base structure impermeable to fluids; said polymeric resin material forming an inner layer on said inner side of said base structure, said inner layer having a smooth surface; and said polymeric resin material forming an outer layer on said outer side of said base structure, said outer layer having a surface with a plurality of indentations, said indentations being knuckle-shaped impressions spaced apart from one another in said outer layer.

15. A resin-impregnated endless belt as claimed in claim 14 wherein said base structure is a woven fabric.

16. A resin-impregnated endless belt as claimed in claim 14 wherein said base structure is a non-woven fabric.

17. A resin-impregnated endless belt as claimed in claim 14 wherein said base structure is a knitted fabric.

18. A resin-impregnated endless belt as claimed in claim 14 wherein said base structure is a braided fabric.

19. A resin-impregnated endless belt as claimed in claim 14 wherein said base structure is an extruded sheet of a polymeric resin material.

20. A resin-impregnated endless belt as claimed in claim 14 wherein said base structure is an extruded mesh fabric.

21. A resin-impregnated endless belt as claimed in claim 14 wherein said base structure is a spiral-link fabric.

22. A resin-impregnated endless belt as claimed in claim 14 wherein said base structure is a strip material spirally wound in a plurality of turns, each turn being joined to those adjacent thereto by a continuous seam, said base structure being endless in a longitudinal direction, said strip material being selected from the group consisting of woven fabrics, nonwoven fabrics, knitted fabrics, braided fabrics, extruded sheets of polymeric material and extruded mesh fabrics.

23. A resin-impregnated endless belt as claimed in claim 14 wherein said polymeric resin material is polyurethane.

24. A resin-impregnated endless belt as claimed in claim 14 wherein said surface of said outer layer comprises an imprint of a woven fabric, said fabric being woven from yarns producing a plurality of knuckles forming protrusions on a side thereof, said protrusion forming said indentations on said surface of said outer layer.

* * * * *